US010688337B2

(12) United States Patent
Arst et al.

(10) Patent No.: US 10,688,337 B2
(45) Date of Patent: Jun. 23, 2020

(54) EXERCISE DEVICE WITH PORT

(71) Applicant: Isoped, LLC, Medford, OR (US)

(72) Inventors: Lani Arst, Central Point, OR (US); Peter Hollingworth, Medford, OR (US); Jacob W. Ensign, Medford, OR (US)

(73) Assignee: Isoped, Incorporated, Medford, OR (US)

( * ) Notice: Subject to any disclaimer, the term of this patent is extended or adjusted under 35 U.S.C. 154(b) by 0 days.

(21) Appl. No.: 15/070,937

(22) Filed: Mar. 15, 2016

(65) Prior Publication Data

US 2016/0193497 A1 Jul. 7, 2016

Related U.S. Application Data

(63) Continuation-in-part of application No. 14/667,573, filed on Mar. 24, 2015, now Pat. No. 9,283,424, (Continued)

(51) Int. Cl.

| | |
|---|---|
| ***A63B 22/02*** | (2006.01) |
| ***A63B 21/015*** | (2006.01) |
| ***A63B 21/00*** | (2006.01) |
| ***A63B 71/00*** | (2006.01) |
| ***A63B 22/00*** | (2006.01) |
| ***A63B 24/00*** | (2006.01) |
| ***A63B 21/16*** | (2006.01) |

(52) U.S. Cl.

CPC ..... *A63B 22/0292* (2015.10); *A63B 21/015* (2013.01); *A63B 22/02* (2013.01); *A63B 21/00069* (2013.01); *A63B 21/00181* (2013.01); *A63B 21/1609* (2015.10); *A63B 22/0023* (2013.01); *A63B 22/025* (2015.10); *A63B 22/0235* (2013.01); *A63B 24/0087* (2013.01); *A63B 2022/0038* (2013.01); *A63B 2022/0097* (2013.01); *A63B 2022/0278* (2013.01); *A63B 2024/0093* (2013.01); *A63B 2071/0018* (2013.01); *A63B 2071/0081* (2013.01); *A63B 2208/0233* (2013.01); *A63B 2225/09* (2013.01)

(58) Field of Classification Search

CPC ..... A63B 22/04; A63B 23/0417; A63B 21/00178; A63B 21/0058; A63B 2024/0093

See application file for complete search history.

(56) References Cited

U.S. PATENT DOCUMENTS 2,772,881 A * 12/1956 Fundom ..... A61H 1/0259 482/131

3,582,069 A 6/1971 Flick et al.

(Continued)

OTHER PUBLICATIONS

The International Search Report and Written Opinion issued by the Federal Institute of Industrial Property dated Aug. 18, 2016 for the International patent application No. PCT/US2016/023921.

*Primary Examiner* — Jennifer Robertson

(74) *Attorney, Agent, or Firm* — Hall Estill Attorneys at Law

(57) ABSTRACT

An exercise device comprising a base frame comprising one or more belt members, a front axle configured to interface with one of the belt members, a rear axle configured to interface with one of the belt members and a port disposed on an underside of the base.

20 Claims, 14 Drawing Sheets

Related U.S. Application Data which is a continuation-in-part of application No. 13/406,498, filed on Feb. 27, 2012, now Pat. No. 8,986,176, which is a continuation-in-part of application No. 12/798,781, filed on Apr. 12, 2010, now abandoned.

(60) Provisional application No. 61/300,907, filed on Feb. 3, 2010.

(56) References Cited

U.S. PATENT DOCUMENTS 3,941,377 A 3/1976 Lie
4,151,988 A 5/1979 Nabinger
4,204,673 A 5/1980 Speer
4,274,625 A 6/1981 Gaetano
5,044,355 A 9/1991 Peopelle
5,192,257 A * 3/1993 Panasewicz ..... A63B 21/154 482/134
5,195,935 A * 3/1993 Fencel ..... A63B 21/00178 482/52
5,279,531 A 1/1994 Jen-Huey
5,302,162 A 4/1994 Pasero
5,372,560 A 12/1994 Chang
5,433,683 A * 7/1995 Stevens ..... A63B 22/203 482/70
5,538,489 A 7/1996 Magid
5,607,376 A 3/1997 Magid
5,679,101 A 10/1997 Magid
5,860,941 A * 1/1999 Saringer ..... A61H 1/0214 482/4
6,331,153 B1 12/2001 McClellan
6,514,180 B1 * 2/2003 Rawls ..... A63B 21/005 482/51
6,893,382 B1 5/2005 Moon et al.
7,226,396 B2 6/2007 Buechel et al.
2001/0036885 A1 * 11/2001 Castellot, Jr. ..... A63B 21/012 482/79
2004/0132586 A1 7/2004 Leighton et al.
2004/0192516 A1 9/2004 Buechel et al.
2004/0204293 A1 * 10/2004 Andreasen ..... A63B 21/00178 482/52
2006/0003872 A1 * 1/2006 Chiles ..... A63B 21/225 482/57
2011/0152731 A1 6/2011 Ochi et al.
2014/0213414 A1 * 7/2014 Balandis ..... A63B 24/0087 482/5
2015/0360083 A1 * 12/2015 Lagree ..... A63B 24/0075 482/130
2017/0319905 A1 * 11/2017 O'Connor ..... A63B 24/0087
2018/0345074 A1 * 12/2018 Shiao ..... A63B 24/0087

* cited by examiner

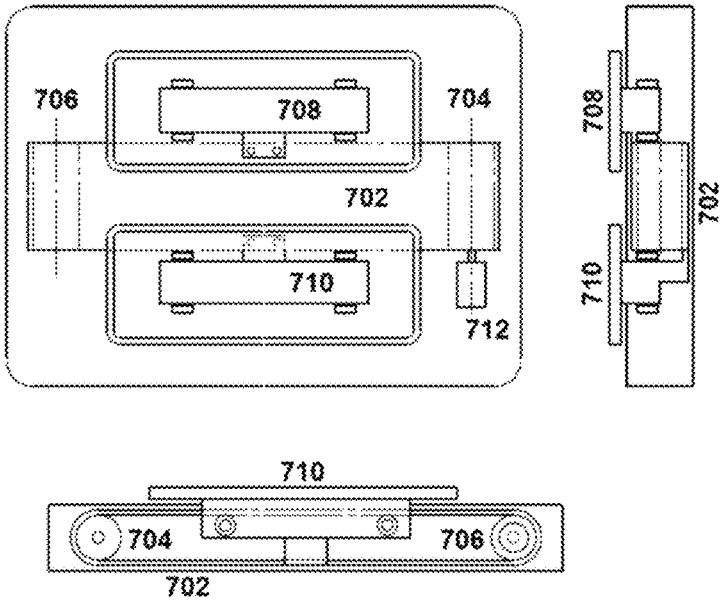
FIGURE 7
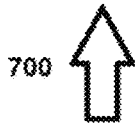
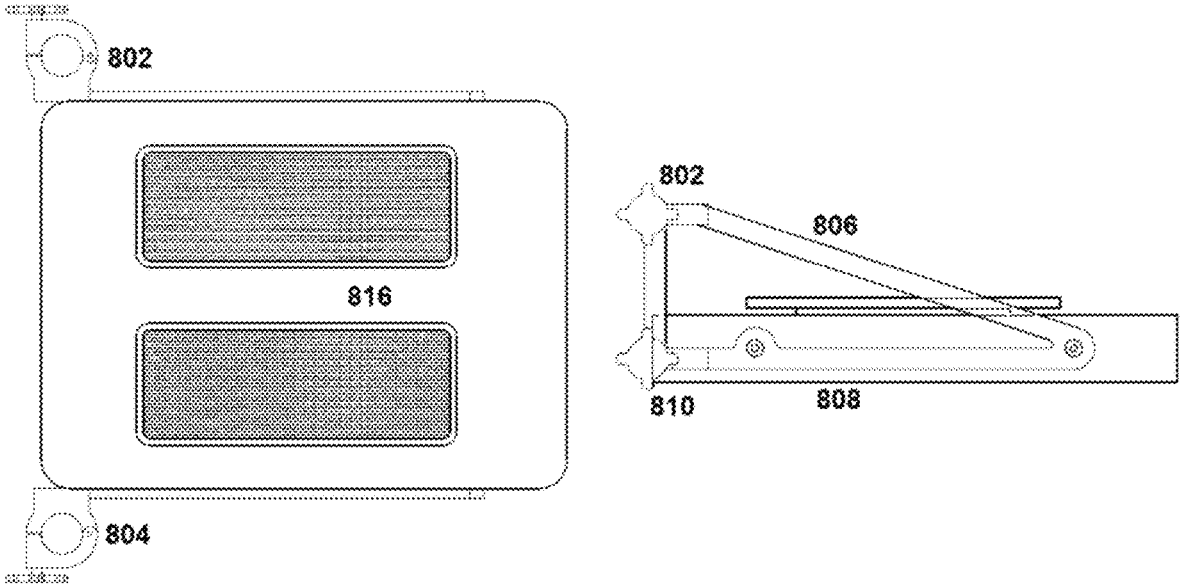
FIGURE 8
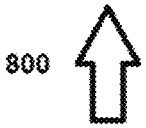

900

1000

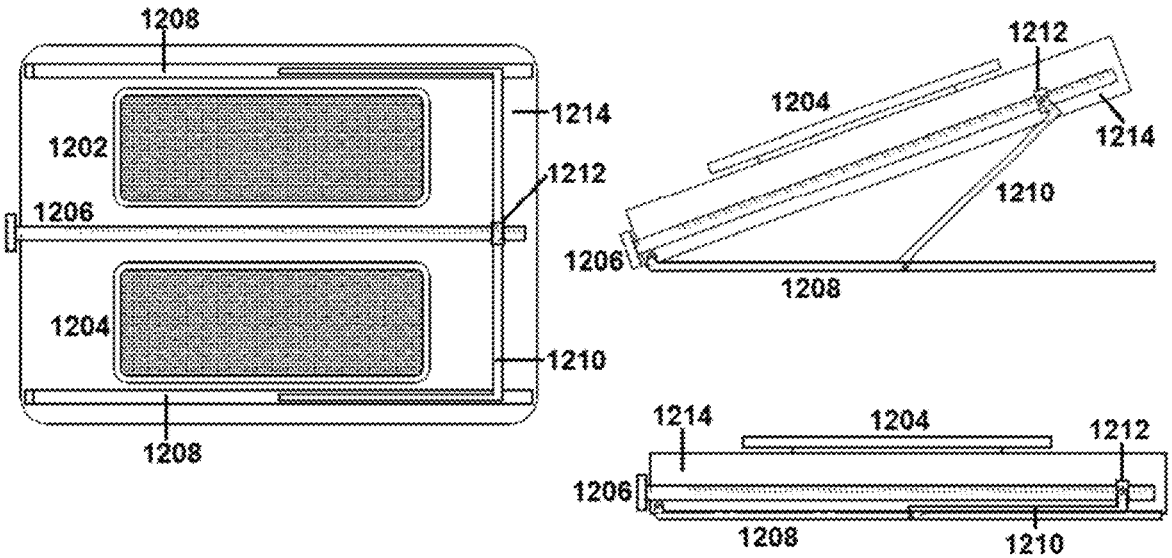
FIGURE 12
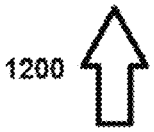
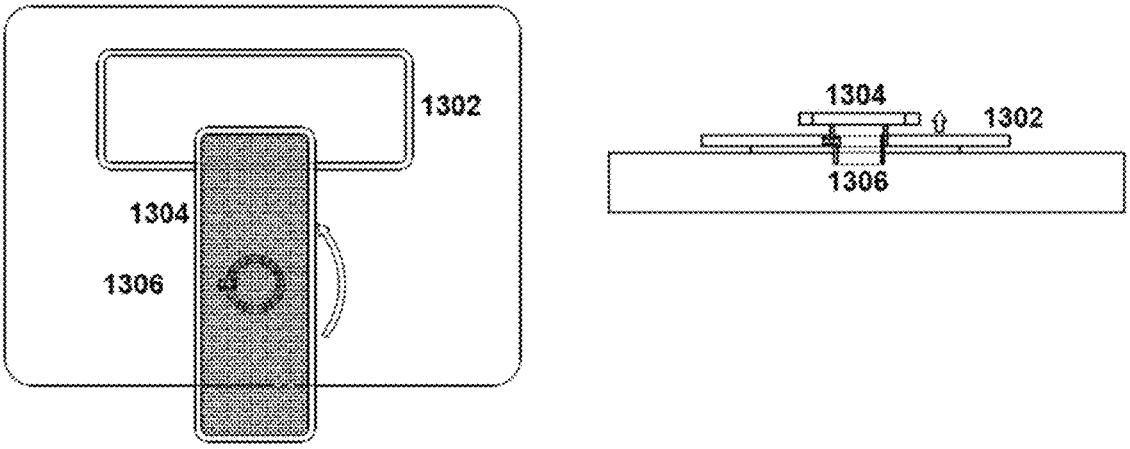
FIGURE 13
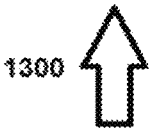

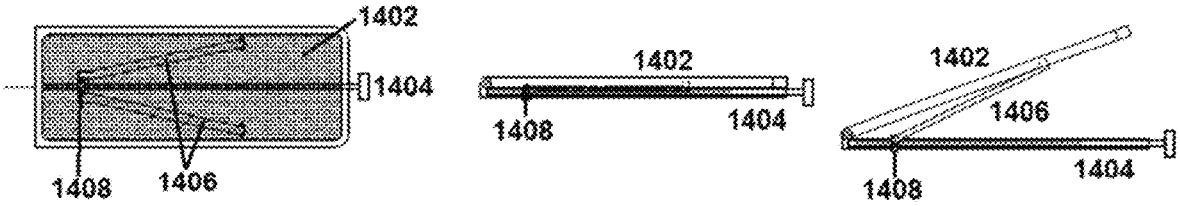
FIGURE 14
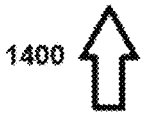
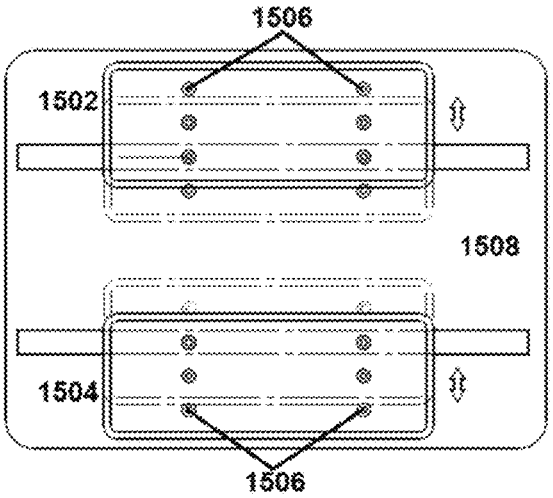
FIGURE 15
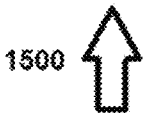

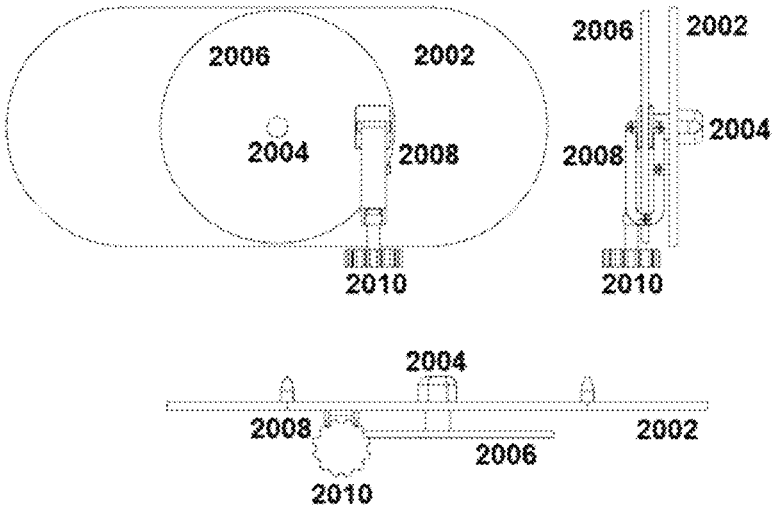
FIGURE 20
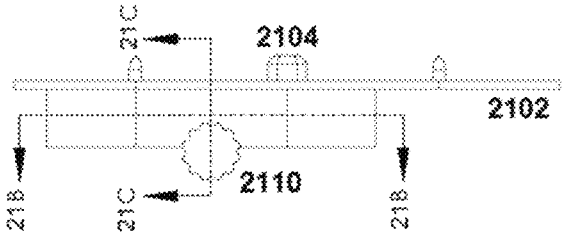
FIGURE 21A
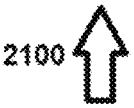
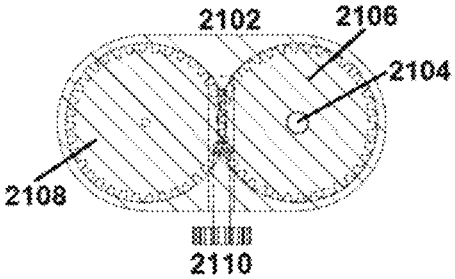
FIGURE 21B
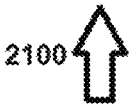
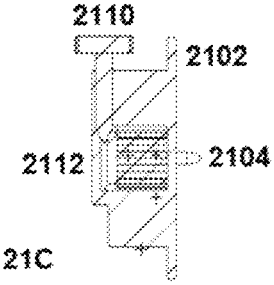
FIGURE 21C
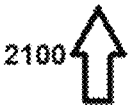

EXERCISE DEVICE WITH PORT

RELATED APPLICATIONS

This application claims priority to U.S. Provisional Patent Application No. 61/300,907, filed Feb. 3, 2010, is a continuation-in-part of U.S. patent application Ser. No. 12/798,781, filed Apr. 12, 2010, is also a continuation-in-part of U.S. patent application Ser. No. 13/406,498, filed Feb. 27, 2012, now U.S. Pat. No. 8,986,176, issued Mar. 24, 2015, and is also a continuation-in-part of U.S. patent application Ser. No. 14/667,573, filed Mar. 24, 2015, now U.S. Pat. No. 9,283,424, issued Mar. 15, 2016, which are each hereby incorporated by reference for all purposes as if set forth in their entirety herein.

TECHNICAL FIELD

The present disclosure relates generally to an exercise device, and more specifically to an exercise device with reciprocating foot motion.

BACKGROUND OF THE INVENTION

The statements in this section merely provide background information related to the present disclosure and may not constitute prior art. Exercise is consistent with physical and mental health, but may be difficult for one with limited mobility, who is chair bound, or with a demanding schedule. A lack of exercise may result in not achieving proper circulation.

SUMMARY OF THE INVENTION

An exercise device is disclosed that includes a base frame that has one or more belt members. A front axle is configured to interface with one of the belt members and a rear axle is configured to interface with one of the belt members. An adjustable support disposed on one side of the base, so as to allow the base to be adjusted to support a user, such as a user in a wheel chair. Further embodiments of the exercise device permit the angle of the base to be adjusted. Additional embodiments include modules that attach to the base and provide further functionality and features, as described more fully herein.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which:

FIG. 7 is a diagram of device having a single horizontal continuous belt, in accordance with an exemplary embodiment of the present disclosure;

FIG. 8 is a diagram of a wheel chair mount for a device, in accordance with an exemplary embodiment of the present disclosure;

FIG. 12 is a diagram of an exercise device having an adjustable base, in accordance with an exemplary embodiment of the present disclosure;

FIG. 13 is a diagram showing a foot plate that can be rotated through 90 degrees relative to an additional foot plate, in accordance with an exemplary embodiment of the present disclosure;

FIG. 14 is a diagram showing a foot plate that can be isolated from an exercise device and used as a foot rest, in accordance with an exemplary embodiment of the present disclosure;

FIG. 15 is a diagram showing foot plates that allow sideways adjustability, in accordance with an exemplary embodiment of the present disclosure;

FIG. 20 is a diagram showing an embodiment of a module that can be added to an exercise device that includes a rotating disc and a clamp that can be manipulated to apply pressure to the rotating disc, in accordance with an exemplary embodiment of the present disclosure;

FIG. 21A is a side view of an embodiment of a module that can be added to an exercise device to include additional functionality, in accordance with an exemplary embodiment of the present disclosure;

FIG. 21B is a cut-away bottom view along axis 21B 21B of FIG. 21A of an embodiment of a module including internal pulley axles and a gear displacement fluid pump, in accordance with an exemplary embodiment of the present disclosure;

FIG. 21C is a cut-away side view along axis 21C-21C of FIG. 21A of an embodiment of a module including internal pulley axles and a gear displacement fluid pump, in accordance with an exemplary embodiment of the present disclosure;

DETAILED DESCRIPTION OF THE INVENTION

Figure 1:
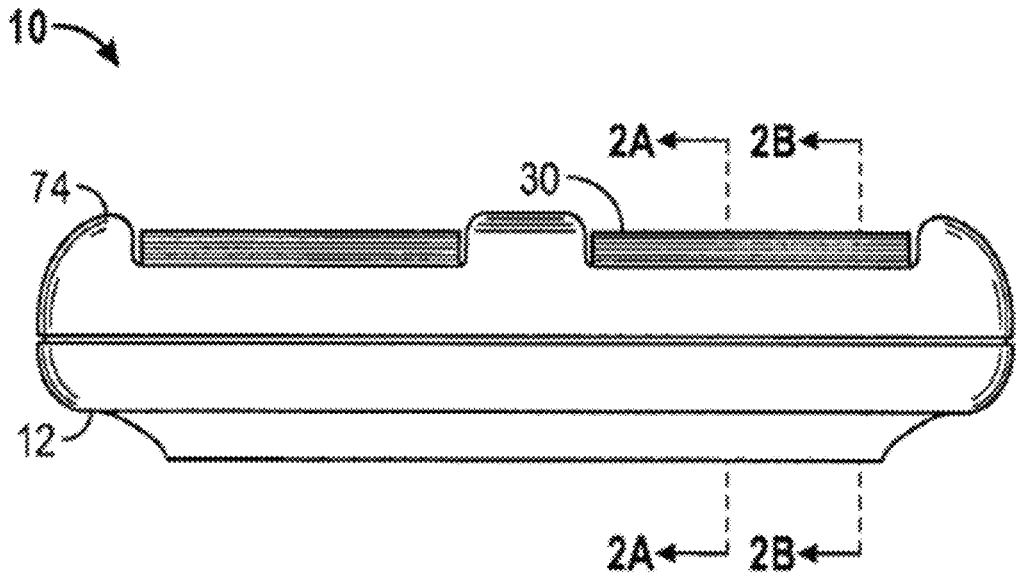
FIG. 1 is a front view of an exercise device according to an embodiment, of the instant disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Rehabilitation is a complex process that is not generally restricted to the hospital environment. A person experiencing issues or problems with the lower limbs including muscle, joint or bone problems may have difficulty with walking or limited mobility. The person may be restricted to a wheelchair during the process of rehabilitation and reliant on the help of others for ambulation or exercise beyond the chair. The person may be on a strict regime of exercise remote from the medical center and staff where the rehabilitation began, they could be in their home or place of work, with few to no options for home exercise equipment and limited access to assistance for weight bearing exercise. Further, when exercise occurs in the home, people find motivation difficult and do not have clear ways of monitoring progress. Lack of regular lower extremity exercise puts people at risk for blood clots, reduces blood flow to the entire body, and can impair cardiovascular function. It leads to greater leg weakness, potentially increasing their reliance on others for mobility and placing them at a greater risk for falls.

The use of a compact, portable device that has the sophistication of medical rehabilitation equipment allows for exercise therapy to continue in the comfort of their own surroundings with the benefit of accurate monitoring of progress and goal setting.

A device is disclosed that can 1) offer movement by an electric motor, 2) offer manual movement driven by the user, 3) simulate work load by adjusting the friction of the drive train; 4) isolate the ankle and knee joints by adjustment of the angle at which the user interfaces with the belts; 5) adjust the movement of the belts to simulate stride length; 6) monitor usage; 7) simulate and monitor power input; 8) offer an assisted movement where manual input is aided by an electric motor; 9) be attached directly to a wheelchair, and that provides numerous other features and advantages as discussed herein.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a physical range listed or described as being useful, suitable, or the like, is intended that any and every value within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

As used in the specification and claims, "near" is inclusive of "at." As used in the specification and claims, "forcibly biased" includes one material or surface being forced against another material or surface. As used herein, a "major axis" of an item is longer than a "minor axis" of the same item. As used herein, a "belt tension" includes a pulling force exerted by the belt when the belt is stretched between two points separated by a distance.

Figure 3A:
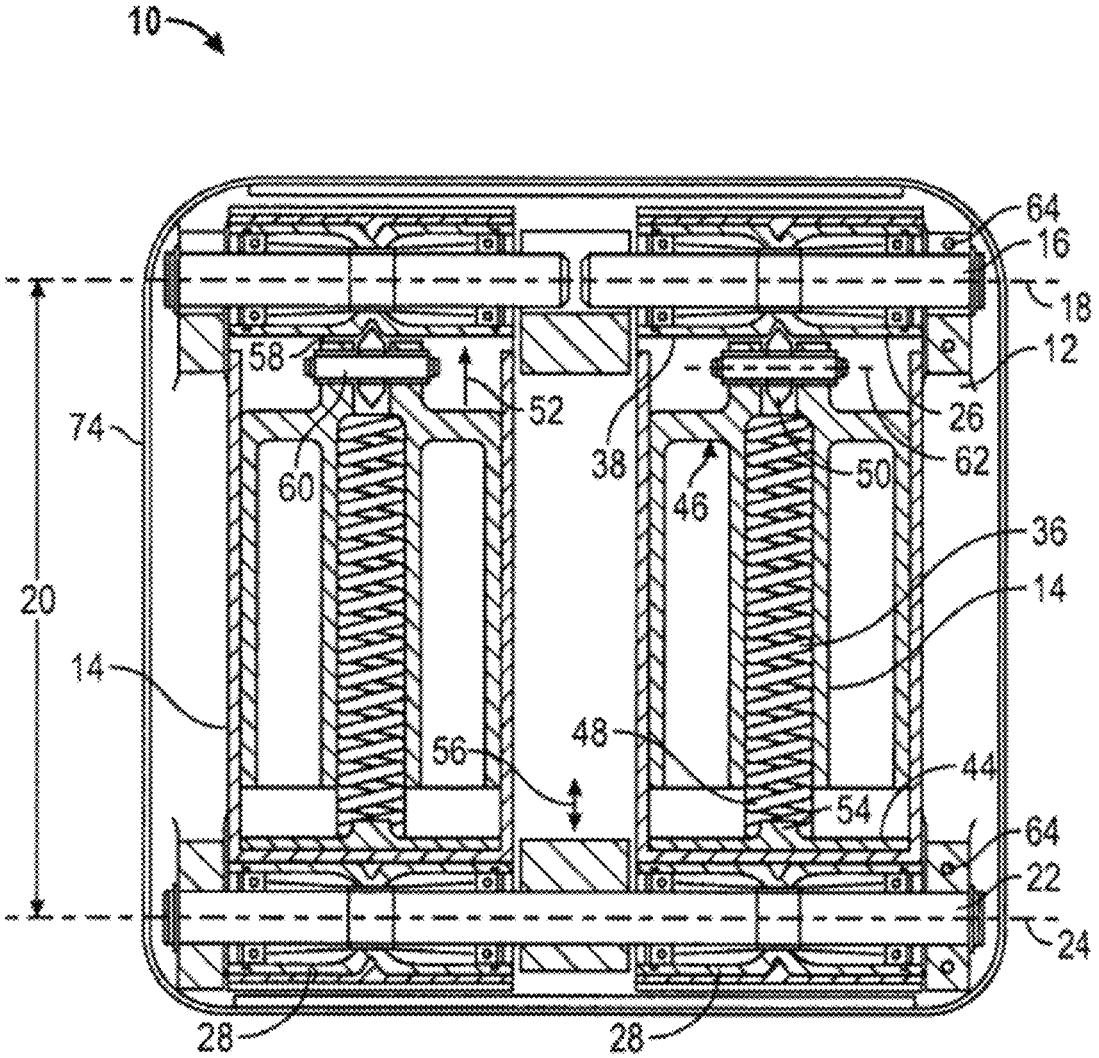
FIG. 3A is a schematic top view of an exercise device according to an embodiment, of the instant disclosure.

As shown in FIG. 3A, in an embodiment, an exercise device 10 comprises a base frame 12 comprising a plurality of belt members, represented generally as 14 attached to, and arranged in parallel on base frame 12. In an embodiment, each of belt members 14 comprises a front axle 16 attached to base frame oriented along a front central axis 18 and separated by a distance 20 from a rear axle 22 attached to base frame 12 having a rear central axis 24. In an embodiment, front central axis 18 is essentially parallel to rear central axis 24.

Figure 2A:
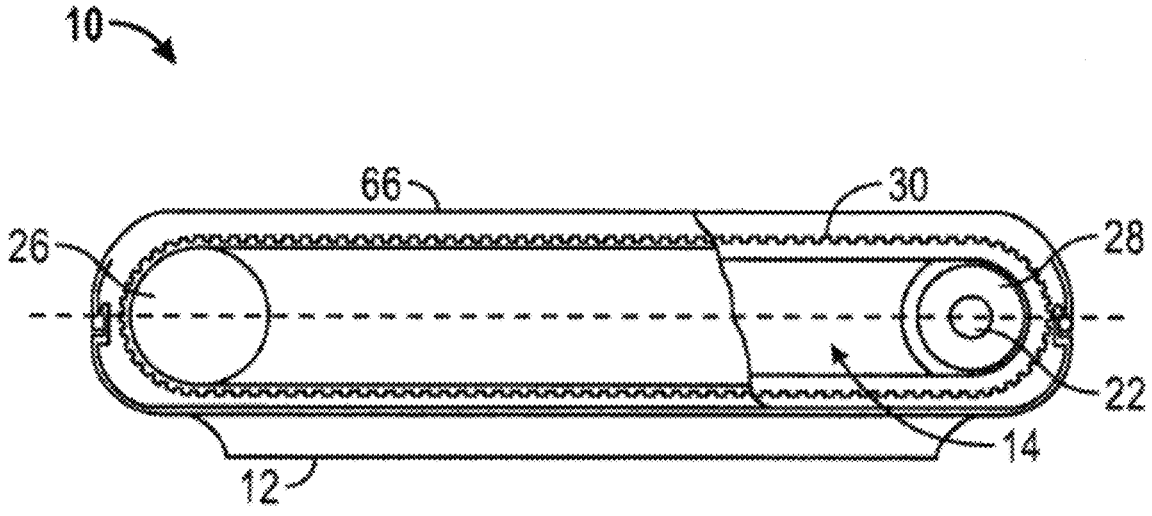
FIG. 2A is a cut-away side view along axis A-A of FIG. 1 of an exercise device according to an embodiment; of the instant disclosure.
Figure 2B:
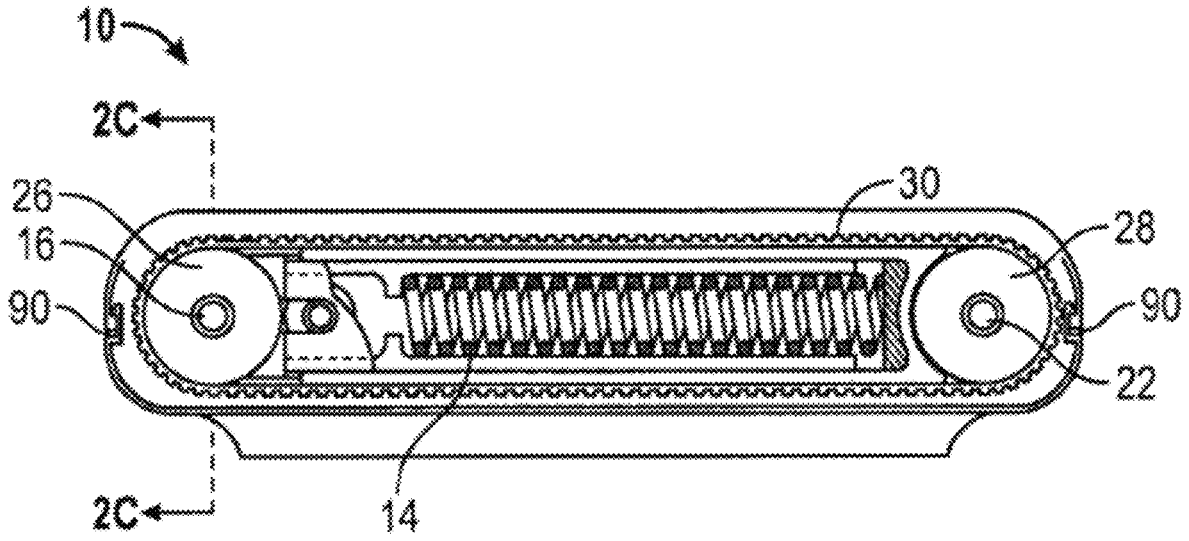
FIG. 2B is a cut-away side view along axis B-B of FIG. 1 of an exercise device according to an embodiment, of the instant disclosure.
Figure 3B:
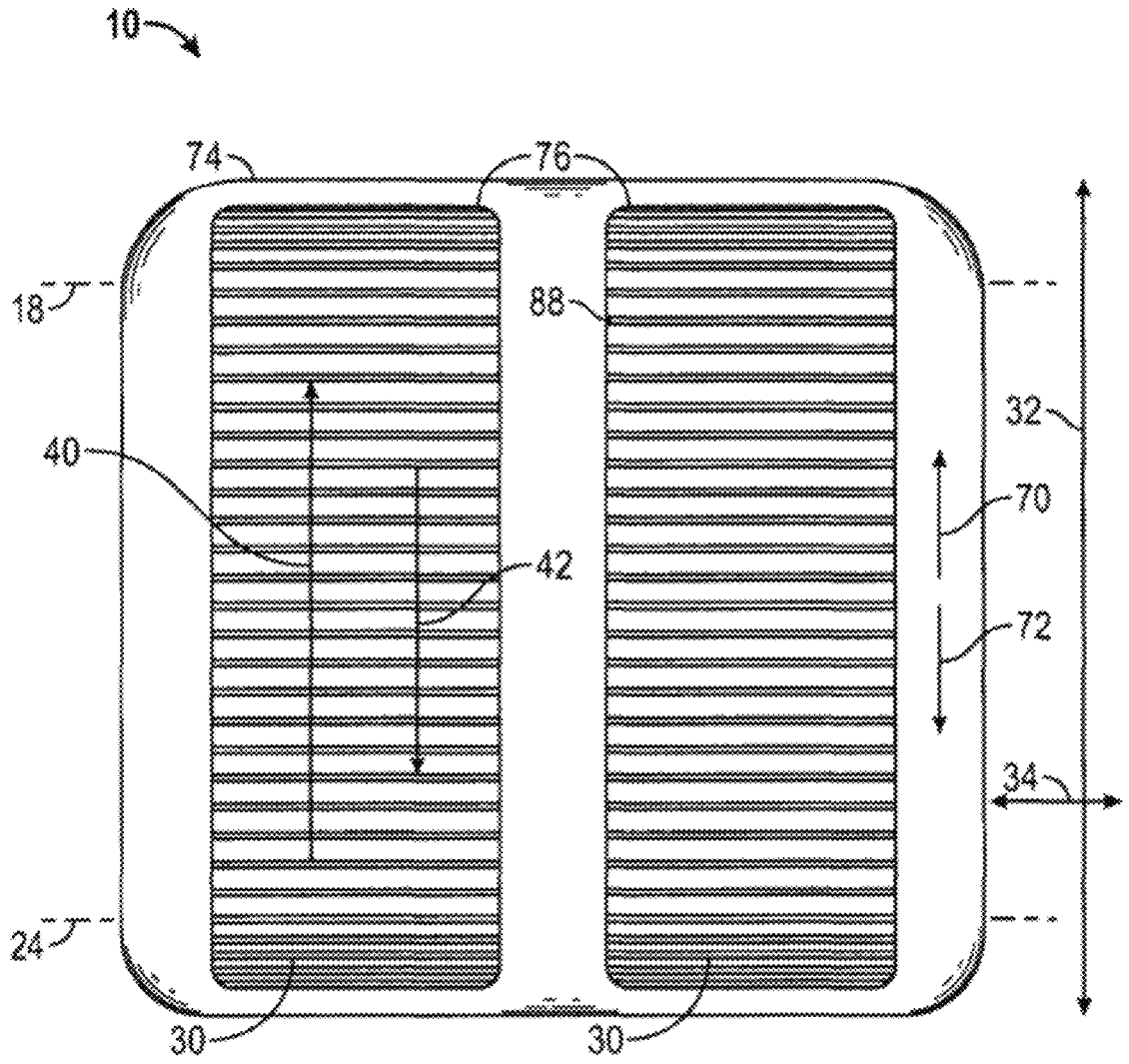
FIG. 3B is a top view of an exercise device according to an embodiment, of the instant disclosure.

In an embodiment, belt member 14 may further comprise a front roller disposed around front axle 16 and arranged to rotate around front central axis 18. Belt member 14 may further comprise a rear roller 28 disposed around rear axle 22 and arranged to rotate around rear central axis 24. As shown in FIGS. 2A and 2B, in an embodiment, belt member 14 may further include an endless belt 30 having an infinite number of sides disposed around and in contact with a portion of front roller 26 and a portion of rear roller 28. As shown in FIG. 3B, in an embodiment, endless belt 30 may have a major axis 32 oriented perpendicular to front central axis 18 and a minor axis 34 oriented parallel to front central axis 18.

In an embodiment, exercise device 10 further comprises at least one frictional member 36 disposed in frictional contact with, and forcibly biased against a surface, generally represented as 38, of at least one front roller 26, rear roller 28, or a combination thereof, such that an external force 40 directed perpendicular to front central axis 18 applied to at least one of the endless belts 30 is opposed by a frictional force 42 provided by frictional contact between frictional member 36 and at least one surface 38 of front roller 26, rear roller 28, or a combination thereof.

In an embodiment, exercise device 10 comprises a frictional member 36 comprising a first end 44 attached to base frame 12, and a second end 46 movably engaged with first end 44, and a resilient member 48 disposed between, and in mechanical contact with first end 44 and second end 46. In an embodiment, second end 46 further comprises a follower 50 arranged in frictional contact with surface 38 of front roller 26 and/or rear roller 28, or a combination thereof (not shown), wherein resilient member 48 is dimensioned and arranged between first end 44 and second end 46 such that follower 50 is forcibly biased against surface 38 (generally represented by force arrow 52) of front roller 26 and/or rear roller, or a combination thereof (not shown), to provide fictional force 42 (see FIG. 3B).

Frictional force 42 may also be described as a drag force, a resistance to rotation of front roller 26 and/or rear roller 28 in response to an externally supplied force 40, and/or the like. In an embodiment, frictional force 42 is diametrically opposed to, and a response to an applied external force 40.

In an embodiment, resilient member 48 may comprise a compressible helical spring, an air compression cylinder and piston arrangement (not shown), and/or the like, so long as resilient member is capable of providing a force 52 to follower 50 such that follower 50 is forcibly biased against any external surface, indicated generally as 38, of front roller 26, rear roller 28, or a combination thereof.

In an embodiment, frictional member 36 may further comprise an adjustment means 54 capable of providing a variable distance 56 between an end of resilient member 48 and first end and/or first end 44 and base frame 12 (not shown), and/or increasing or reducing the compressive force of resilient member such that the amount of bias force 52 exerted between frictional member 36 and surface 38 of at least one of front roller 26, rear roller 28, or a combination thereof is variable between an upper limit and a lower non-zero limit. In an embodiment, bias force 52, and by extension frictional force 42 is greater than zero, such that at least one of the rollers is not free to rotate in the absence of an applied force, but is instead resistant to rotation around its corresponding axis and may only rotate upon application of an external force greater than the bias force applied by the frictional member. Accordingly, in an embodiment, the belt tension, internal or inherent friction of the various bearings, bushings and the like of the rollers, and/or the like are not factored into the representative bias force.

In an embodiment, follower 50 comprises a rotatable member 58 disposed around and in rotational contact with a follower axle 60 attached to second end 46. In an embodiment, follower axle 60 is arranged such that rotatable member 58 has an axis of rotation 62 parallel to front central axis 18.

In an embodiment, front axle 16, rear axle 22, or both are movably attachable 64 to base frame 12. In an embodiment, front axle 16, rear axle 22 are attachable 64 to base frame 12 in an arrangement to provide a belt tension, which is a tensile force represented generally by arrow 66 (see FIG. 2A) between front axle 16 and rear axle 22 through endless belt 30. In an embodiment, belt tension 66, a tensile force, is independent of the frictional force 42 and/or bias force 52 provided by the frictional contact between frictional member 36 and the at least one surface 38 of front roller 26 and/or rear roller 28. Accordingly, in an embodiment, frictional member 36 does not force the front roller to move relative to the rear roller, and/or rear roller to move relative to front roller, but instead provides a frictional force which acts on the rollers to resist rotation of the roller about the axle on which the roller is mounted.

Figure 2C:
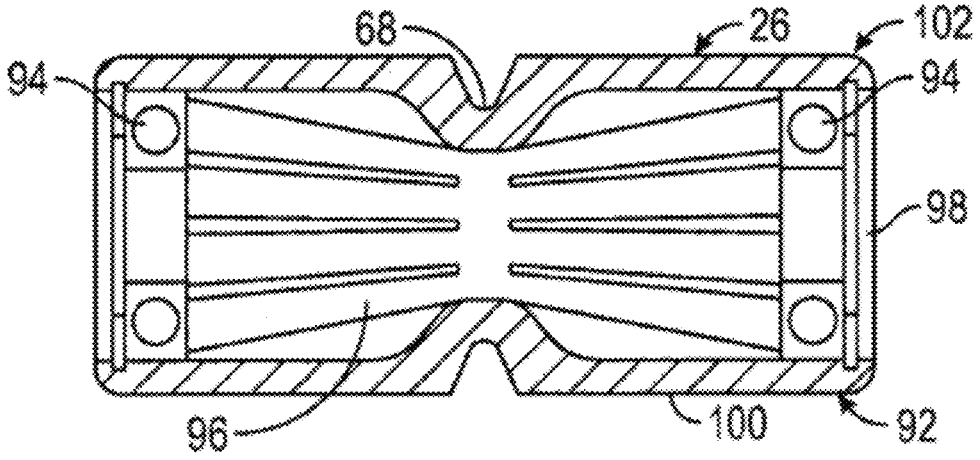
FIG. 2C is a partial cut-away side view along axis C-C of FIG. 2B of an exercise device according to an embodiment, of the instant disclosure.

As shown in FIG. 2C, in an embodiment, front roller 26, rear roller 28, or both comprise a radial groove 68 disposed into the surface of the roller which is dimensioned and arranged to receive a least a portion of frictional member 36, which may include follower 50 (See FIG. 3A).

In an embodiment, frictional member 36 is forcibly biased against surface 38 of front roller 26 and/or rear roller 28 in a direction perpendicular to front central axis 18. In an embodiment, frictional member 36 is forcibly biased against surface 38 of front roller 26 and/or rear roller 28 in a direction parallel to front central axis 18 (not shown).

As shown in FIG. 3B, in an embodiment, exercise device 10 has two belt members 30, wherein front central axis 18 of each of the two belt members and rear central axis 24 of each of the two belt members are collinear.

In an embodiment, at least one frictional member is frictionally engaged with two or more front rollers, two or more rear rollers, or any combination thereof (not shown).

In an embodiment, endless belts 30 of each of the belt members are independently movable in a direction perpendicular to front central axis 18 in a forward direction 70 from rear central axis 24 toward front central axis 18, in a reverse direction 72 from front central axis 18 toward rear central axis 24, or a combination thereof.

In an embodiment, base frame 12 is disposed within an outer covering 74. In an embodiment, outer covering 74 comprising a plurality of openings 76 through which at least a portion of each of endless belts 30 protrudes.

Figure 4:
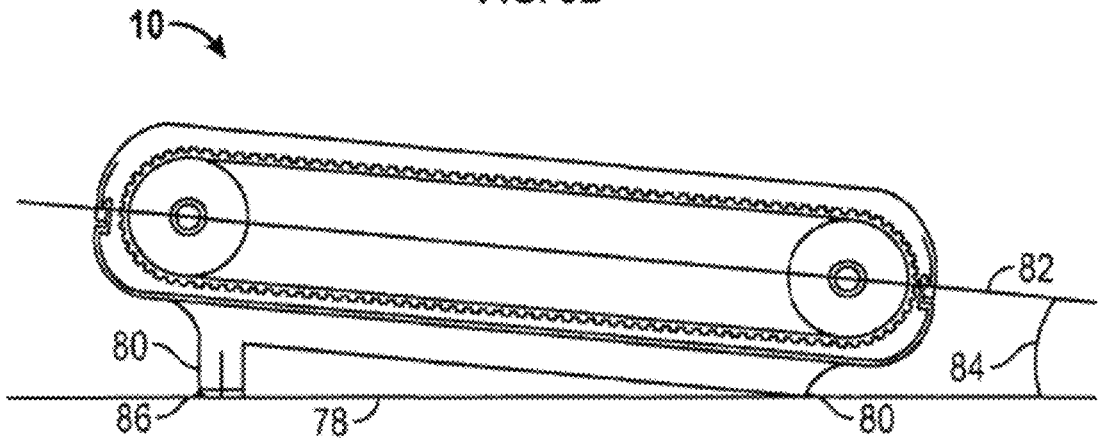
FIG. 4 is a partial cutaway side view of an exercise device according to an embodiment of the instant disclosure disposed on a horizontal surface.

As shown in FIG. 4, in an embodiment, base frame 12 is supported on a horizontal surface 78 by a plurality of supports 80 connected to the base frame, wherein supports 80 are dimensioned and arranged such that a line 82 connecting front central axis 18 and rear central axis 24 is oriented at an angle 84 of less than or equal to about 60°, or less than or equal to about 50°, or less than or equal to about 40°, or less than or equal to about 30°, or less than or equal to about 20°, or less than or equal to about 10° relative to horizontal surface 78.

In an embodiment, at least one of the plurality of supports 80 is independently adjustable 86 such that the angle between line 82 connecting front central axis 18 and rear central axis 24 and horizontal surface 78 is adjustable between about 0° and about 60° relative to horizontal surface 78.

In an embodiment, frictional force 42 opposed to applied external force 40 directed perpendicular to front central axis 18 applied to at least one of the endless belts 30 is from about 1% to less than or equal to about 90%, or less than or equal to about 80%, or less than or equal to about 70%, or less than or equal to about 60%, or less than or equal to about 50%, or less than or equal to about 40%, or less than or equal to about 30%, or less than or equal to about 20%, or less than or equal to about 10% of applied external force 40. In an embodiment, frictional force 42 may be from about 0.44 N (0.1 pound force) to about 44.5 N (10 pound force).

In an embodiment, distance 20 is greater than or equal to about 10 cm and less than or equal to about 50 cm and/or the minor axis 34 of endless belt 30 is from about 5% to about 90% of distance 20.

In an embodiment, endless belt 30 comprises a plurality of ribs 88 disposed on one or more sides of endless belt 30. In an embodiment, the plurality of ribs 88 are oriented perpendicular to or at an acute angle relative to major axis 32 of endless belt 30.

In an embodiment, a method to exercise comprises applying an external force to an endless belt of an embodiment of an exercise device as described herein in an amount sufficient to overcome the frictional force provided by the exercise device opposed to the applied force. In an embodiment, a method to exercise comprises applying an external force to an endless belt of an embodiment of an exercise device as described herein in an amount sufficient to overcome the frictional force provided by the exercise device opposed to the applied force, wherein the external force is applied by a user's foot and/or leg, wherein the user is a person in a sitting position.

In an embodiment, the exercise device according to an embodiment may provide the user with a passive resistance to normal motion of the back of the thigh muscles, the lower legs (calves) and ankles while sitting. Since the motion may be in a periodic or a reciprocating action, similar to walking, little or no motion would be transmitted from the user to the chair or other sitting device. However, this exercise device disclosed herein may be utilized in a standing position depending on the physical limitations of the user.

In an embodiment, internal part count and weight may be minimized and the components designed to minimize the use of friction in all moving parts. In an embodiment, the exercise device may be designed to require zero maintenance for a period of at least three years.

In an embodiment, the base frame assembly may serve as the primary structure wherein all vertical and horizontal loads are reacted by, and transferred through, the base member into the surface on which the device is disposed. The exercise device according to the instant disclosure may be designed to allow easy assembly of all working components during manufacturing as well as during shop servicing. In an embodiment, material selection for the various components including the material to be used in the fabrication of the base frame may include steel, glass fiber reinforced bulk molding compound (bmc), fiberglass, and/or the like. In an embodiment, a recyclable base polymer may be specified. In an embodiment, the base frame material may be chosen such that the base frame is able to withstand a minimum of 15 drops from a height of 36 inches (as part of the finished product) without cracking or damage to any of the internal parts.

In an embodiment, the base frame may be designed to support a maximum static (non-operating) load of at least about 250 pounds evenly distributed over each of the belts. Loads passed through the base frame will be reacted by the floor or a structurally sound platform supplied by the end user. Material thickness and sections may be determined by allowable deflections based on anticipated external, as well as internal, loading according to methods well understood by one of minimal skill in the art. In an embodiment, the outer covering comprises two separate pieces, which may be dimensioned and arranged to snap together using an integral snap device 90 as shown in FIG. 2B. In an embodiment, mechanical fasteners may be used to hold the two or more separate pieces together.

The outer cover serves to protect all internal components from liquid spills and damage from falling objects. As depicted in FIG. 1, all features are generously radiused to prevent injury during handling or transport. The parting line between the base member and the outer cover may be held to a profile tolerance sufficient to minimize gaps. The material which may be used in the fabrication of the outer cover may be the same or different as the material used to produce the base frame.

In and embodiment, the outer cover may be dimensioned to withstand overhead drops of a 1 pound steel object at a height of 12 inches one time at any location without cracking through.

The endless belts may further comprise a surface modifier comprising a low friction layer such as perfluoroethylene to minimize wear. In an embodiment, the endless belts may comprise and elastomeric base material, which may include ethylene propylene diene monomer (epdm) rubber, butyl rubber, and/or the like, which may be further reinforced with carbon fiber, metal cords, polyester cords, and/or the like.

Lateral ribs disposed on a surface of the belt may be molded to provide comfortable contact with bare feet and may be dimensioned to facilitate bending around the two rollers without cracking.

As shown in FIG. 2C, in an embodiment, the front and/or rear rollers 26 or 28 may comprise a roller assembly 102 comprising two ball bearings 94, two bearing retainers 98, an inner core 96, and an outer shell 100. The "v" notch or radial groove disposed into the roller may be dimensioned and arranged to provide guidance of each belt engagement which may be over 180° of arc, and to activate the separating load via rolling contact on center with the rotatable member of the follower.

In an embodiment, the rollers, and/or any surface of the device may comprise a wear resistant surface treatment 92 which may include a coating of titanium-nitride or the like for wear resistance. In an embodiment, the bearings 94 utilized in the design may be self-lubricated, steel, plastic, and/or ceramic ball type bearings and/or bushings which may be sealed to reduce likelihood of contamination. In an embodiment, the frictional member may comprise metal, and/or a polymeric resin, which may include glass or other fiber reinforced polyetheretherketone (peek), nylon, ABS, and/or the like. In an embodiment, the front axle, the rear axle, or both may an alloy steel, may be heat treated, or a combination thereof.

In an embodiment, the resilient member comprises a helical spring. The adjustment means may include a threaded member and corresponding seat adapted to receive the threaded member such that rotation of the threaded member increases or decreases the amount of compression of the spring, thereby providing an adjustment of the frictional force provided by the exercise device in response to an applied force. In an embodiment, the adjustment means is accessible from the outer surface of the exercise device such that the frictional force may be adjusted by the end user. In an embodiment, the frictional member may be oriented to produce the bias force parallel to the front central axis such that the frictional force is applied to an end of the roller. In an embodiment, the resilient member may comprise a gas charged cylinder-piston arrangement capable of producing a consistent outward force. In an embodiment, the pressure in the gas charged cylinder-piston arrangement may be adjustable or variable to allow for adjustment of the frictional force. In an embodiment, the frictional force may be provide by a plurality of frictionally engaged dampers which rotate with a roller relative to a stationary platform which exerts a force on the dampers, with or without a resilient member, to provide the frictional force.

In accordance with the foregoing, various embodiments are disclosed:

Embodiment A

An exercise device comprising: a base frame comprising a plurality of belt members attached to, and arranged in parallel on the base frame, wherein each of the belt members comprises: a front axle attached to the base frame oriented along a front central axis separated by a distance from a rear axle attached to the base frame having a rear central axis, wherein the front central axis is essentially parallel to the rear central axis; a front roller disposed around the front axle and arranged to rotate around the front central axis; a rear roller disposed around the rear axle and arranged to rotate around the rear central axis; an endless belt having an infinite number of sides disposed around and in contact with a portion of the front roller and a portion of the rear roller, the endless belt having a major axis oriented perpendicular to the front central axis and a minor axis oriented parallel to the front central axis; the exercise device further comprising at least one frictional member disposed in frictional contact with, and forcibly biased against a surface of at least one front roller, rear roller, or a combination thereof such that an external force directed perpendicular to the front central axis applied to at least one of the endless belts is opposed by a frictional force provided by the frictional contact between the frictional member and the at least one surface of the front roller, the rear roller, or a combination thereof.

Embodiment B

The exercise device according to embodiment A, wherein the frictional member comprises a first end attached to the base frame, and a second end movably engaged with the first end, and a resilient member disposed between, and in mechanical contact with the first end and the second end, wherein the second end further comprises a follower arranged in frictional contact with the surface of the front roller, the rear roller, or a combination thereof, wherein the resilient member is dimensioned and arranged between the first end and the second end such that the follower is forcibly biased against the surface of the front roller, the rear roller, or a combination thereof, to provide the fictional force.

Embodiment C

The exercise device according to embodiment A or B, wherein the resilient member comprises a compressible helical spring.

Embodiment D

The exercise device according to embodiment A, B, or C, wherein the frictional member further comprises an adjustment means capable of providing a variable distance between the resilient member and the first end, the first end and the base frame, or a combination thereof such that the amount of bias force between the frictional member and the surface of at least one of the front roller, the rear roller, or a combination thereof is variable between an upper limit and a lower non-zero limit.

Embodiment E

The exercise device according to embodiment A, B, C, or D, wherein the follower comprises a rotatable member disposed around and in rotational contact with a follower axle attached to the second end, wherein the follower axle is arranged such that the rotatable member has an axis of rotation parallel to the front central axis.

Embodiment F

The exercise device according to embodiment A, B, C, D, or E, wherein the front axle, the rear axle, or both are movably attachable to the base frame, and are attachable to the base frame in an arrangement to provide a belt tension between the front axle and the rear axle through the endless belt, wherein the belt tension is independent of the frictional force provided by the frictional contact between the frictional member and the at least one surface of the front roller, the rear roller, or a combination thereof.

Embodiment G

The exercise device according to embodiment A, B, C, D, E, or F, wherein the front roller, the rear roller, or both comprise a radial groove disposed into the surface of the roller which is dimensioned and arranged to receive a least a portion of the follower.

Embodiment H

The exercise device according to embodiment A, B, C, D, E, F, or G, wherein the frictional member is forcibly biased against the surface of the front roller, the rear roller, or both in a direction perpendicular to the front central axis.

Embodiment I

The exercise device according to embodiment A, B, C, D, E, F, G, or H having two belt members, wherein the front central axis and the rear central axis of each of the belt members are collinear.

Embodiment J

The exercise device according to embodiment A, B, C, D, E, F, G, H, or I, comprising at least one frictional member which is frictionally engaged with two or more of the front rollers, two or more of the rear rollers, or any combination thereof.

Embodiment K

The exercise device according to embodiment A, B, C, D, E, F, G, H, I, or J, wherein each of the endless belts are independently movable in a direction perpendicular to the front central axis in a direction from the rear central axis toward the front central axis, in a direction from the front central axis toward the rear central axis, or a combination thereof.

Embodiment L

The exercise device according to embodiment A, B, C, D, E, F, G, H, I, J, or K, wherein the base frame is disposed within an outer covering, the outer covering comprising a plurality of openings through which at least a portion of each of the endless belts protrudes through.

Embodiment M

The exercise device according to embodiment A, B, C, D, E, F, G, H, I, J, K, or L, wherein the base frame is supported on a horizontal surface by a plurality of supports connected to the base frame, and wherein the supports are dimensioned and arranged such that a line connecting the front central axis and the rear central axis is oriented at an angle of less than or equal to about 60° relative to the horizontal surface.

Embodiment N

The exercise device according to embodiment A, B, C, D, E, F, G, H, I, J, K, L, or M, wherein at least one of the plurality of supports is independently adjustable such that the angle between the line connecting the front central axis and the rear central axis and the horizontal surface is adjustable between about 0° and about 60° relative to the horizontal surface.

Embodiment O

The exercise device according to embodiment A, B, C, D, E, F, G, H, I, J, K, L, M, or N, wherein the frictional force opposed to the applied external force directed perpendicular to the front central axis applied to at least one of the endless belts is from about 1% to less than or equal to about 90% of the applied external force.

Embodiment P

The exercise device according to embodiment A, B, C, D, E, F, G, H, I, J, K, L, M, N, or O, wherein the distance is greater than or equal to about 10 cm and less than or equal to about 50 cm, and wherein the minor axis of the endless belt is from about 5% to about 90% of the distance.

Embodiment Q

The exercise device according to embodiment A, B, C, D, E, F, G, H, I, J, K, L, M, N, O, or P, wherein the endless belt comprises a plurality of ribs disposed on one or more sides of the endless belt.

Embodiment R

The exercise device according to embodiment A, B, C, D, E, F, G, H, I, J, K, L, M, N, O, P, or Q, wherein the plurality of ribs are oriented perpendicular to the major axis of the endless belt.

Embodiment S

A method to exercise comprising applying an external force to an endless belt of an exercise device in an amount sufficient to overcome a frictional force provided by the exercise device opposed to the applied force, wherein the exercise device comprises any one of the embodiments of A-R.

Embodiment T

A method to exercise comprising applying an external force to an endless belt of an exercise device in an amount sufficient to overcome a frictional force provided by the exercise device opposed to the applied force, wherein the exercise device comprises a base frame comprising a plurality of belt members attached to, and arranged in parallel on the base frame, wherein each of the belt members comprises: a front axle attached to the base frame oriented along a front central axis separated by a distance from a rear axle attached to the base frame having a rear central axis, wherein the front central axis is essentially parallel to the rear central axis; a front roller disposed around the front axle and arranged to rotate around the front central axis; a rear roller disposed around the rear axle and arranged to rotate around the rear central axis; the endless belt having an infinite number of sides disposed around and in contact with a portion of the front roller and a portion of the rear roller, the endless belt having a major axis oriented perpendicular to the front central axis and a minor axis oriented parallel to the front central axis; the exercise device further comprising at least one frictional member disposed in frictional contact with, and forcibly biased against a surface of at least one front roller, rear roller, or a combination thereof such that the external force directed perpendicular to the front central axis applied to at least one of the endless belts is opposed by the frictional force provided by the frictional contact between the frictional member and the at least one surface of the front roller, the rear roller, or a combination thereof.

Figure 5:
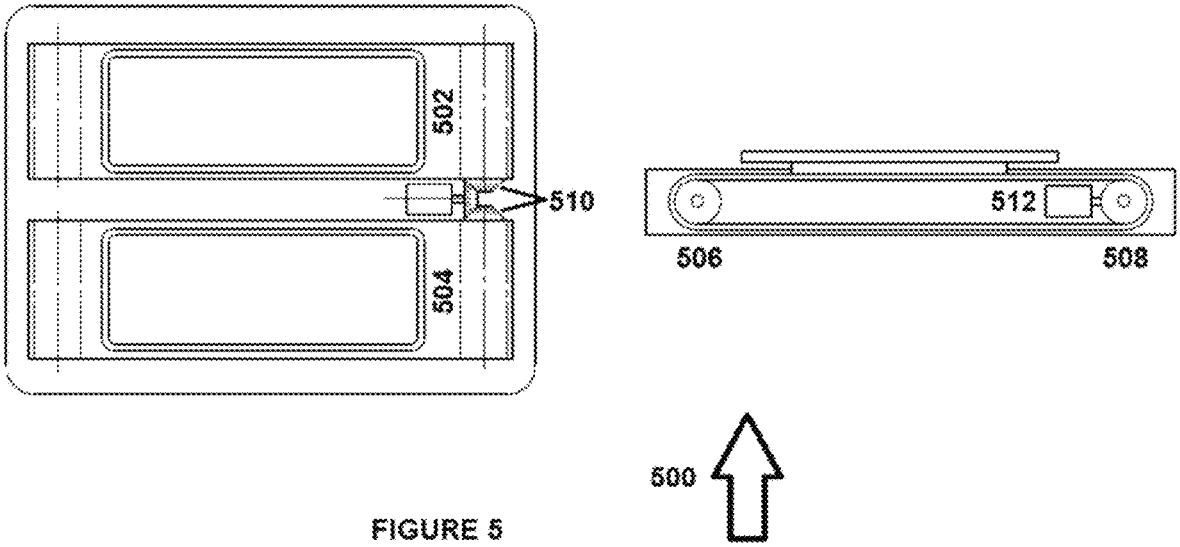
FIG. 5 is a diagram of a device having two independent continuous belts, in accordance with an exemplary embodiment of the present disclosure.

FIG. 5 is a diagram of a device 500 having two independent continuous belts 502 and 504, in accordance with an exemplary embodiment of the present disclosure. The belts 502 and 504 are tensioned by axles 506 and 508, which are coupled to the base frame and which are also independent of each other. The front axles have a beveled gear 510 on the inside facing each other. A device 512 that engages a planetary gear to the two bevel gears connects the two belts 502 and 504, forcing opposed movement of the belts, such that when one belt moves forward, the other moves backward, to simulate a walking motion. Attaching an electric motor (not explicitly shown) to the planetary gear can be used to create assisted movement. Attaching an electronic device (not explicitly shown) to the front axle can be used to collect data for calories burned, distance traveled, time elapsed or other suitable functions, and can allow friction to be applied to the axle to simulate load, such as by applying regenerative braking, resistive friction, a spring tension or in other suitable manners.

Using the electric motor to both power the plates and to add resistance to the plates can be accomplished by using the electric motor as an electric generator in a reverse mode of operation.

One or more algorithms operating on a processor can be used to control the load/movement resistance when the device is being used in human input mode. If the virtual load on the generator is changed, then the resistance on the plates is changed and hence the human input is made easier or harder. This manipulation of the virtual load can simulate walking, both distance and grade. The algorithms can also be used in an "assist" mode, as a program used for rehabilitation where initial use can be set to human input mode, but as the input fades due to fatigue, the software changes the virtual load to reduce resistance on the plates allowing the user to complete a given schedule or meet set rehabilitation goals. In assist mode the unit may also go further, switching from resistance on the plates to motorized motion of the plates, which can be achieved by sensing fatigue of the user and switching from power generator to electric motor mode.

In operation, the components of device 600 can be implemented in conjunction with the other structural and functional components discussed and disclosed herein, to provide an exercise device.

Figure 6:
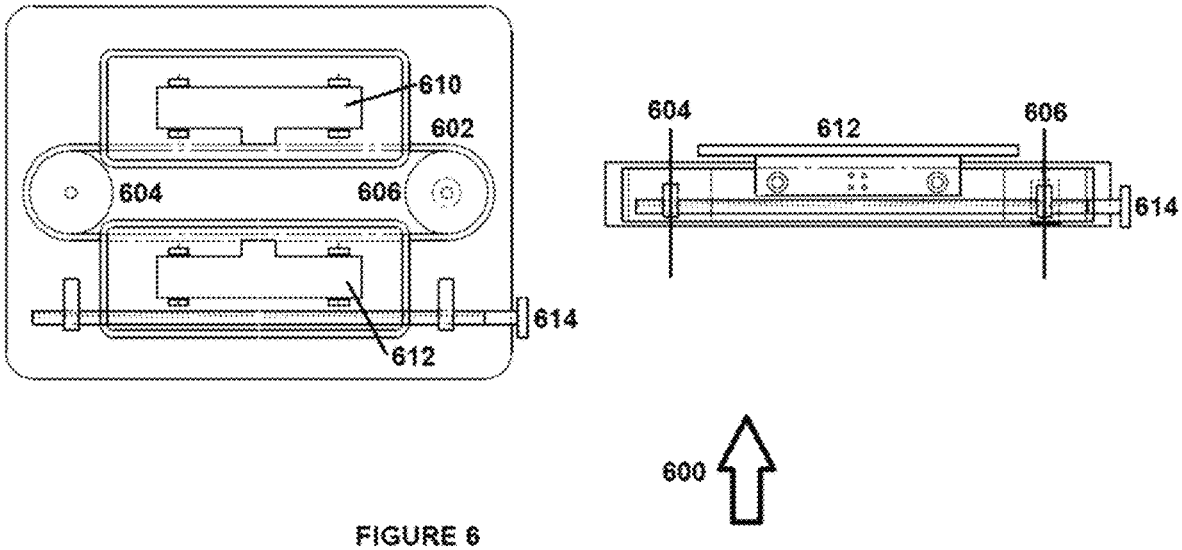
FIG. 6 is a diagram of a device having a single vertical continuous belt, in accordance with an exemplary embodiment of the present disclosure.

FIG. 6 is a diagram of a device 600 having a single vertical continuous belt 602, in accordance with an exemplary embodiment of the present disclosure. Belt 602 is tensioned by independent vertical axles 604 and 606, which have centerline axes of rotation that are disposed vertically to the surface on which device 600 is placed, as opposed to the horizontal axes of rotation of device 500. Foot plates 610 and 612 are attached to the outer face of continuous belt 602 between vertical axles 604 and 606. The movement of foot plates 610 and 612 is opposed, such that when one plate moves forward, the other moves backward, to simulate a walking motion. An electronic device (not explicitly shown) can be attached to the front axle to collect data for calories burned, distance traveled, time elapsed or other suitable functions, and also to allow friction to be applied to the axle to simulate load. A travel adjustment device 614 can be provided that allows the device to be configured to set a movement range, such as to simulate a user's length of stride. In one exemplary embodiment, travel adjustment device 614 can provide adjustable stops that block lateral movement of foot plates 610 and 612 in a forward or reverse direction, or can otherwise restrict the range of movement of foot plates 610 and 612, so as to help prevent the user from inadvertently slipping off the exercise device when they stand up.

In operation, the components of device 700 can be implemented in conjunction with the other structural and functional components discussed and disclosed herein, to provide an exercise device.

FIG. 7 is a diagram of device 700 having a single horizontal continuous belt 702, in accordance with an exemplary embodiment of the present disclosure. Belt 702 is tensioned by independent axles 704 and 706. Foot plates 708 and 710 are attached via brackets to the inner face of continuous belt 702 between axles 704 and 706. One plate is attached to the uppermost side of belt 702 and one to the lowermost side of belt 702. The movement of the plates is opposed, i.e. when one plate moves forward the other moves backward, to simulate a walking motion. An electronic device 712 can be attached to front axle 704 to collect data for calories burned, distance traveled, time elapsed or other suitable functions, and can allow friction to be applied to the axle to simulate load. An electric motor (not explicitly shown) can be attached to the axle to create assisted movement.

In operation, the components of device 700 can be implemented in conjunction with the other structural and functional components discussed and disclosed herein, to provide an exercise device.

FIG. 8 is a diagram of a wheel chair mount 800 for a device, in accordance with an exemplary embodiment of the present disclosure. Wheel chair mount 800 includes releasable upper supports 802 and 804 and releasable lower supports 810 (opposite lower support is not explicitly shown), which can be readily attached to wheel chair structural components or other suitable devices. In one exemplary embodiment, releasable upper supports 802 and 804 and release lower supports 810 can include one or more clips, set screws or other suitable devices that allow releasable upper supports 802 and 804 and release lower supports 810 to be securely attached to bars, chair legs, braces or other suitable structural components. Lateral supports 806 and 808 are coupled to exercise device 816 (which can be one or the exercise devices disclosed herein or other suitable exercise devices) in a suitable location, and provide support for exercise device 816. Wheel chair mount 800 can be used to isolate the ankle and knee joints by adjustment of the angle at which the user interfaces with the belts.

Figure 9:
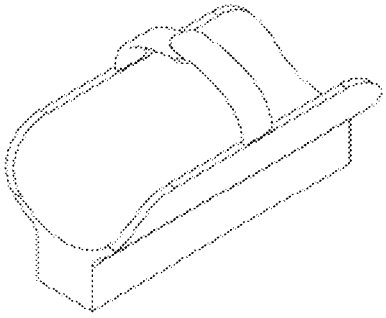
FIG. 9 is a diagram showing an additional attachment for calf or arm to display digital information and control devices, in accordance with an exemplary embodiment of the present disclosure.

FIG. 9 is a diagram showing an additional device that may be used to support the forearm while using an exemplary embodiment of the exercise devices disclosed herein or other suitable exercise devices, in accordance with an exemplary embodiment of the present disclosure.

Figure 10:
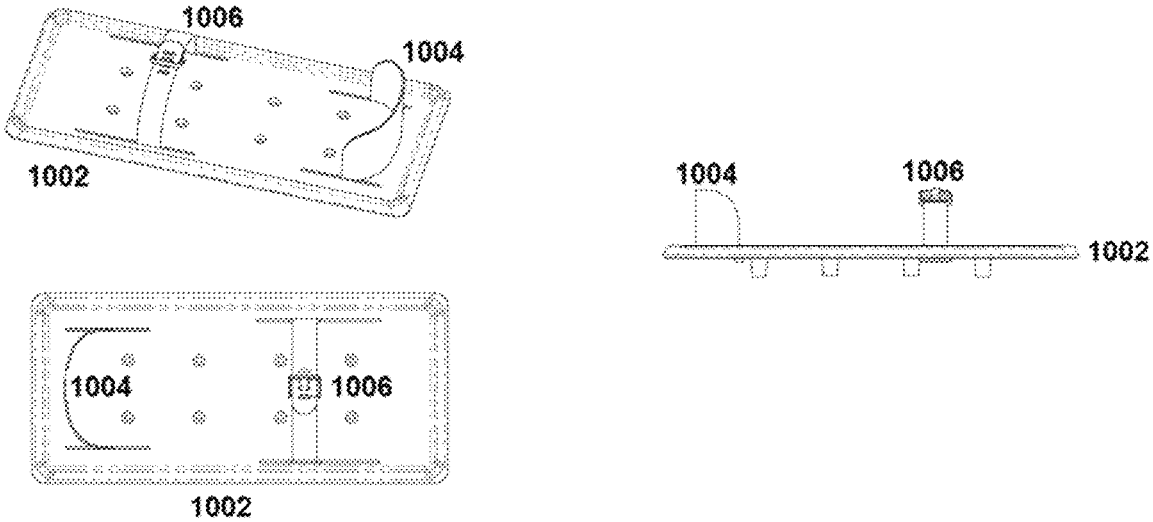
FIG. 10 is a diagram showing an adjustable foot plate, in accordance with an exemplary embodiment of the present disclosure.

FIG. 10 is a diagram showing an adjustable foot plate 1000, in accordance with an exemplary embodiment of the present disclosure, with an adjustable ankle support 1004 and a strap 1006 to secure a user's foot to one of the associated foot plates 1002.

Figure 11:
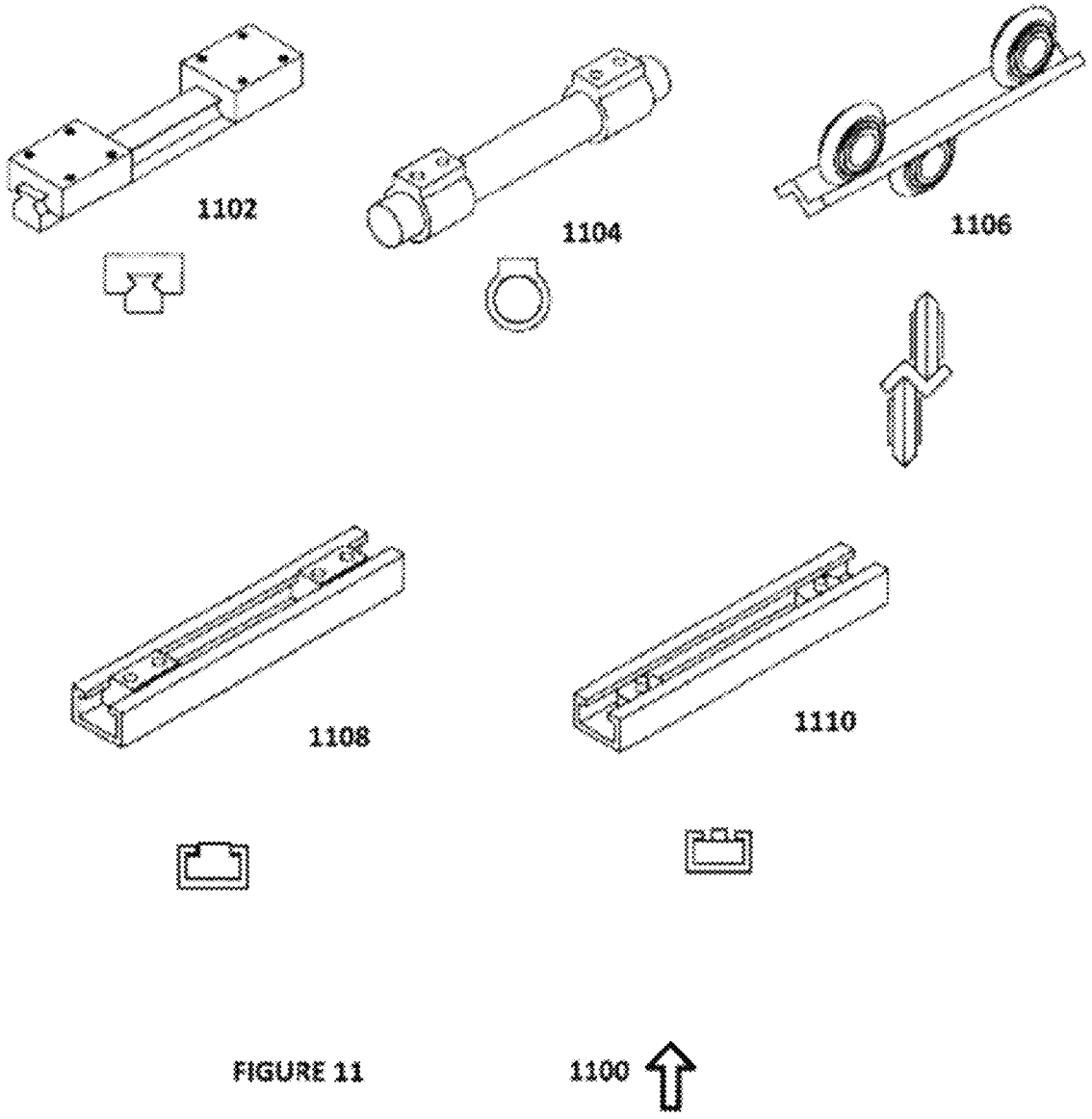
FIG. 11 is a diagram showing different embodiments of a guide system for foot plates to prevent lateral or twisting motion in the movement of the plates, in accordance with an exemplary embodiment of the present disclosure.

FIG. 11 is a diagram showing different embodiments of a guide system for foot plates to prevent lateral or twisting motion in the movement of the plates, in accordance with an exemplary embodiment of the present disclosure. The rail designs 1102, 1108 and 1110 can be implemented using low friction materials (plastics, ceramics, metals and the like), can include internal recirculating ball-bearing features, or can use other suitable materials or devices. Tube design 1104 and roller design 1106 can also or alternatively be used.

FIG. 12 is a diagram of device 1200 having an adjustable base, in accordance with an exemplary embodiment of the present disclosure. In this embodiment, angle adjustment device 1206 is located between foot plates 1202 and 1204. Device 1200 includes base support arms 1208, which are attached to exercise device 1214 (which can be one of the exercise devices disclosed herein or other suitable exercise devices) in a suitable location and preferably in a pivotal manner. Adjustable support 1210 is attached to base support arms 1208 at a suitable location and also preferably in a pivotal manner. Adjustable support 1210 is also attached to angle adjustment device 1206 at a connection point 1212 which securely holds adjustable support 1210 in a selected position. Varying the position of connection point 1212 along angle adjustment device 1206 allows exercise device 1214 to be articulated in a vertical motion to isolate the ankle and knee joints by adjustment of the angle at which the user interfaces with the foot plates 1202 and 1204.

FIG. 13 is a diagram of a device 1300 having a foot plate 1304 that can be rotated through 90 degrees relative to foot plate 1302, in accordance with an exemplary embodiment of the present disclosure. Foot plate 1304 turns on a cam 1306 which lifts foot plate 1304 above foot plate 1302. Device 1300 allows a user to place one foot on rotated foot plate 1304 and one foot on the floor and exercise the hip by moving the raised foot and leg from side to side, opening the hip joint.

FIG. 14 is a diagram of a device 1400 in which a foot plate 1402 can be isolated from an exercise device (which can be one of the exercise devices disclosed herein or other suitable exercise devices) and used as a foot rest, in accordance with an exemplary embodiment of the present disclosure. Device 1400 includes base support 1404 which is attached to foot plate 1402 in a suitable location and preferably in a pivotal manner, as well as adjustable support arms 1406, which are also attached to foot plate 1402, preferably in a pivotal manner as well. Base support 1404 is attached to adjustable support arms 1406 at a connection point 1408 which securely holds adjustable support arms 1406 in a selected position. Varying the position of connection point 1408 along base support 1404 allows foot plate 1402 to be articulated in a vertical motion to allow it to function as a foot rest, such as when the exercise device is being used to simulate a stepper or in other situations.

FIG. 15 is a diagram of a device 1500 having foot plates 1502 and 1504 that allow sideways adjustability, in accordance with an exemplary embodiment of the present disclosure. Foot plates 1502 and 1504 contain pre-drilled holes 1506 that enable the foot plates to be set at different foot positions relative to exercise device 1508 (which can be one of the exercise devices disclosed herein or other suitable exercise devices) so that foot position is optimized for comfort and correct position for exercise. In preferred embodiments, bolts or screws are passed through holes 1506 in order to fasten foot plates 1502 and 1504 to exercise device 1508 in a suitable manner.

Figure 16:
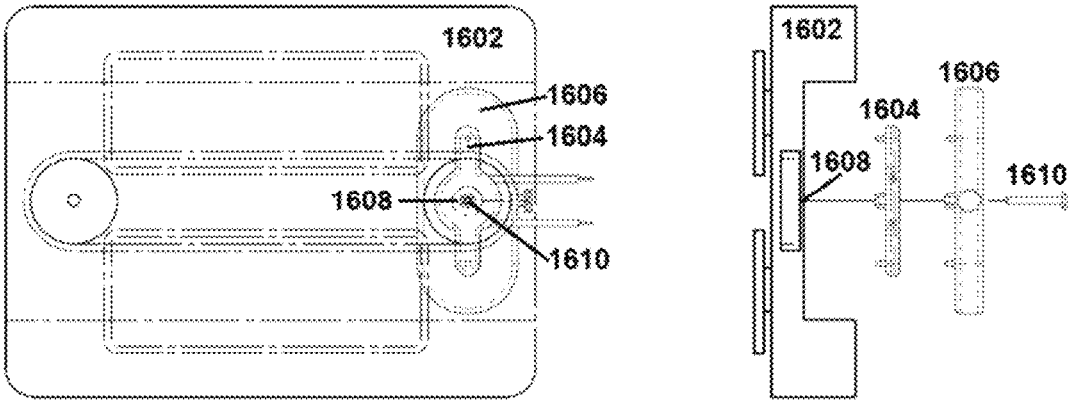
FIG. 16 is a diagram showing different embodiments of modules that can be attached in a stacking fashion to an exercise device through a port on the exercise device, in accordance with an exemplary embodiment of the present disclosure.

FIG. 16 is a diagram of a device 1600 in which modules 1604 and 1606 can be attached to an exercise device 1602 (which can be one of the exercise devices disclosed herein or other suitable exercise devices), in accordance with an exemplary embodiment of the present disclosure. Exercise device 1602 includes a module port 1608 which permits attachment of modules 1604 and 1606. Module port 1608 may be collinear with vertical axle 606 shown in FIG. 6, and preferably collinear with an axis of rotation of vertical axle 606, and may be located on the underside of exercise device 1602. In the preferred embodiment shown in FIG. 16, modules 1604 and 1606 are stacked and attached to exercise device 1602 at module port 1608 using a bolt 1610. Any suitable connector may be used in place of bolt 1610, including screws or clips. Attachment of modules 1604 and 1606 through module port 1608 and, as seen in FIG. 6, at vertical axle 606, allows the modules to directly interact with vertical axle 606 and to monitor or affect the use of exercise device 1602. In preferred embodiments, the modules, including modules 1604 and 1606, will add additional functionality to exercise device 1602. For example, modules usable in preferred embodiments of the present disclosure include electronic devices to monitor usage and produce detailed outputs of individual leg and foot activity. Modules that are electronic may also include batteries to supply power when desired and storage in order to record electronic data collected during use. Single modules may be used, or multiple modules may be used in a stacking configuration as seen in FIG. 16.

Figure 17:
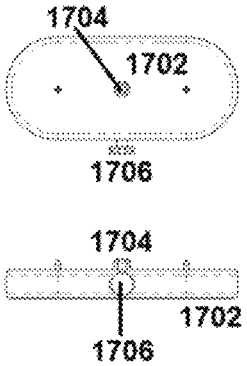
FIG. 17 is a diagram showing an embodiment of a module that can be added to an exercise device that includes an knob for adjustment, in accordance with an exemplary embodiment of the present disclosure.

FIG. 17 is a diagram of a device 1700 through which additional functionality can be added to an exercise device (which can be one of the exercise devices disclosed herein or other suitable exercise devices) by attachment of module 1702 to the exercise device, in accordance with an exemplary embodiment of the present disclosure. Module 1702 includes a port 1704 which may be collinear with module port 1608 seen in FIG. 16, and which facilitates attachment to the exercise device. Module 1702 includes a knob 1706 which may be used to adjust resistance of the exercise device or provide additional functionality.

Figure 18:
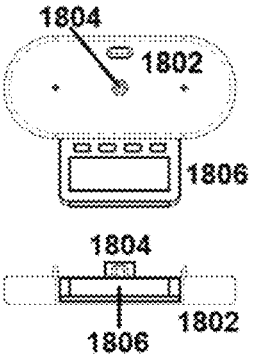
FIG. 18 is a diagram showing an embodiment of a module that can be added to an exercise device and that includes an electronic unit which may be used to record and display electronic data relating to use of the exercise device, in accordance with an exemplary embodiment of the present disclosure.

FIG. 18 is a diagram of a device 1800 through which additional functionality can be added to an exercise device (which can be one of the exercise devices disclosed herein or other suitable exercise devices) by attachment of module 1802 to the exercise device, in accordance with an exemplary embodiment of the present disclosure. Module 1802 includes a port 1804 which may be collinear with module port 1608 seen in FIG. 16, and which facilitates attachment to the exercise device. Module 1802 includes an electronic unit 1806 which may be used to record and display electronic data relating to use of the exercise device or provide additional functionality.

Figure 19:
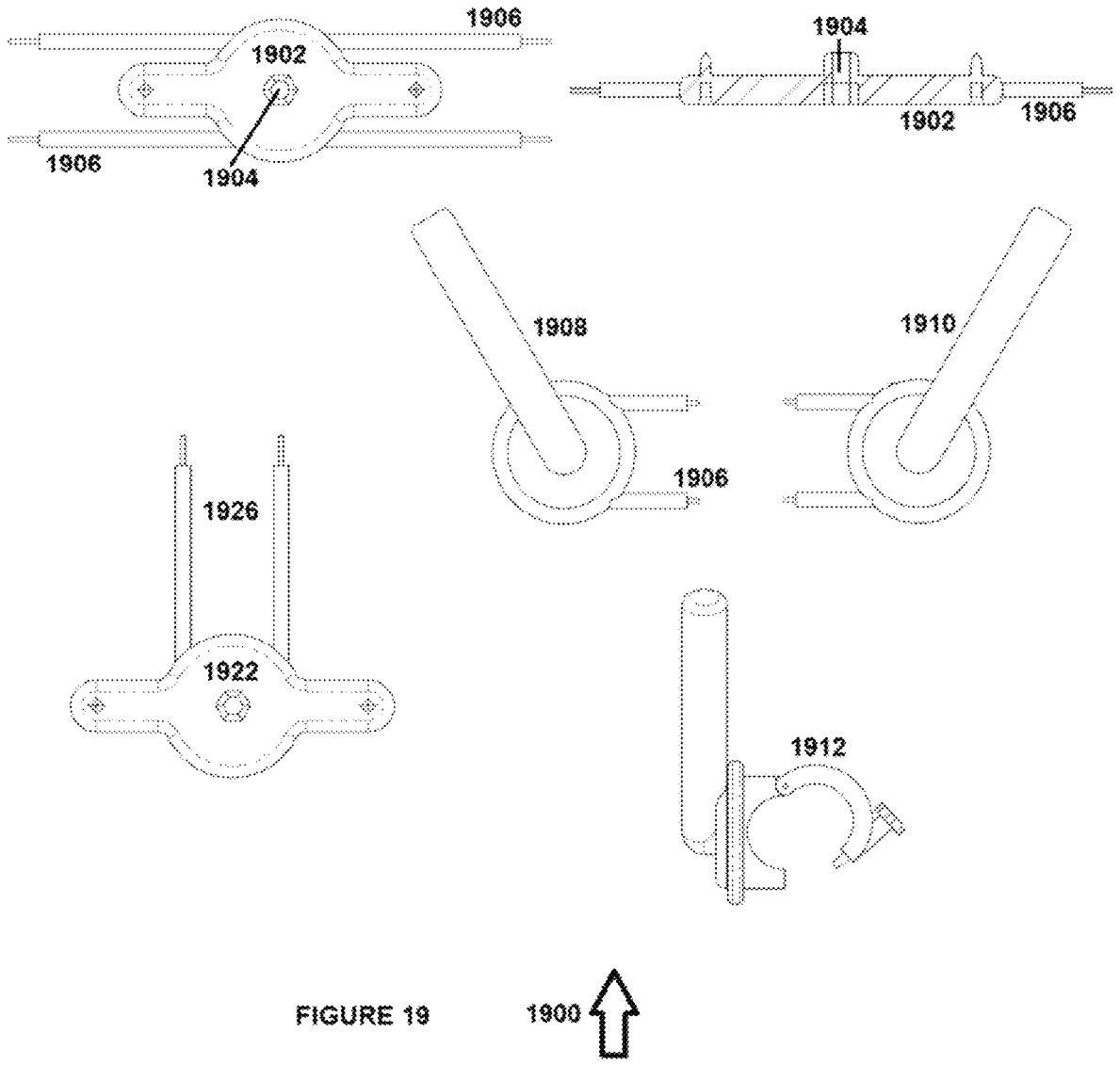
FIG. 19 is a diagram showing an embodiment of a module that can be added to an exercise device and that includes cables extruding from sides of the module which may be part of a cable and pulley system, in accordance with an exemplary embodiment of the present disclosure.

FIG. 19 is a diagram of a device 1900 through which additional functionality can be added to an exercise device (which can be one of the exercise devices disclosed herein or other suitable exercise devices) by attachment of module 1902 to the exercise device, in accordance with an exemplary embodiment of the present disclosure. Module 1902 includes a port 1904 which may be collinear with module port 1608 seen in FIG. 16, and which facilitates attachment to the exercise device. Module 1902 includes cables 1906 extruding from sides of the module and which may be part of a cable and pulley system (with internal pulleys not explicitly shown). Cables 1906 connect to remote levers 1908 and 1910. These levers may be used to simulate a motion opposite the direction of foot plates of the exercise device and are operated by hand and arm movement. Remote levers 1908 and 1910 may include releasable mount 1912 which may be used to secure the remote levers in a remote location for use. In an alternate embodiment, module 1922 utilizes an alternate exit for cables 1926. Cables 1926 may connect to remove levers 1908 and 1910 in a similar fashion as shown for cables 1906.

FIG. 20 is a diagram of a device 2000 through which additional functionality can be added to an exercise device (which can be one of the exercise devices disclosed herein or other suitable exercise devices) by attachment of module 2002 to the exercise device, in accordance with an exemplary embodiment of the present disclosure. Module 2002 includes a rotating disc 2006 and a port 2004 which may be collinear with module port 1608 seen in FIG. 16, and which facilitates attachment to the exercise device. Module 2002 further includes a clamp 2008 which may be manipulated using knob 2010 to apply pressure to either side of the rotating disc 2006 through a friction based material or to provide additional functionality.

An additional exemplary embodiment of the present disclosure is shown in FIG. 21A. In this embodiment, device 2100 allows for additional functionality to be added to an exercise device (which can be one of the exercise devices disclosed herein or other suitable exercise devices) through the attachment of module 2102. Module 2102 has a port 2104 which may be collinear with module port 1608 seen in FIG. 16, and which facilitates attachment to the exercise device. As seen more clearly in FIG. 21B, module 2102 includes internal pulley axles 2106 and 2108, with internal axle 2106 being centered around port 2104. As seen in FIG. 21C, in this embodiment, module 2102 includes a gear displacement fluid pump 2112 attached to pulley axles 2106 and 2108. A valve (not explicitly shown) that is part of gear displacement fluid pump 2112 can be operated by knob 2110 to adjust the amount of oil flowing through a circuit (not explicitly shown), which causes resistance to the movement of pulley axles 2106 and 2108.

Figure 22A:
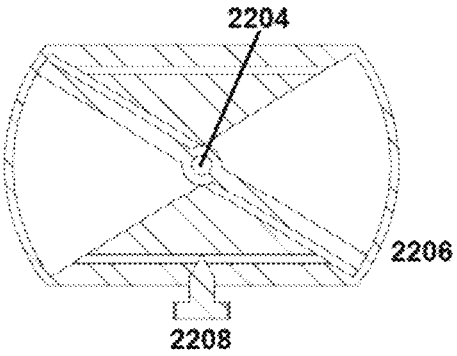
FIG. 22A is a cut-away bottom view along axis 22A-22A of FIG. 22B of an embodiment of a module including a vane fluid pump, in accordance with an exemplary embodiment of the present disclosure.
Figure 22B:
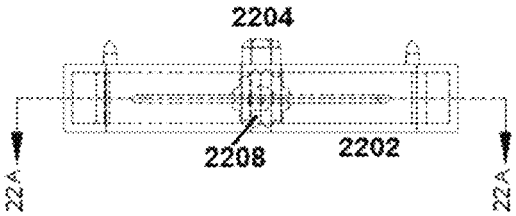
FIG. 22B is a side view of an embodiment of a module that can be added to an exercise device to include additional functionality, in accordance with an exemplary embodiment of the present disclosure.

An additional exemplary embodiment of the present disclosure is shown in FIG. 22B. In this embodiment, device 2200 allows for additional functionality to be added to an exercise device (which can be one of the exercise devices disclosed herein or other suitable exercise devices) through the attachment of module 2202. Module 2202 has a port 2204 which may be collinear with module port 1608 seen in FIG. 16, and which facilitates attachment to the exercise device. In this embodiment, module 2202 includes vane fluid pump 2206 seem more clearly in FIG. 22A. A valve (not explicitly shown) in vane fluid pump 2206 can be operated via knob 2208 to adjust the amount of oil flowing through a circuit (not explicitly shown) causing resistance to the movement of the pulley.

Figure 23:
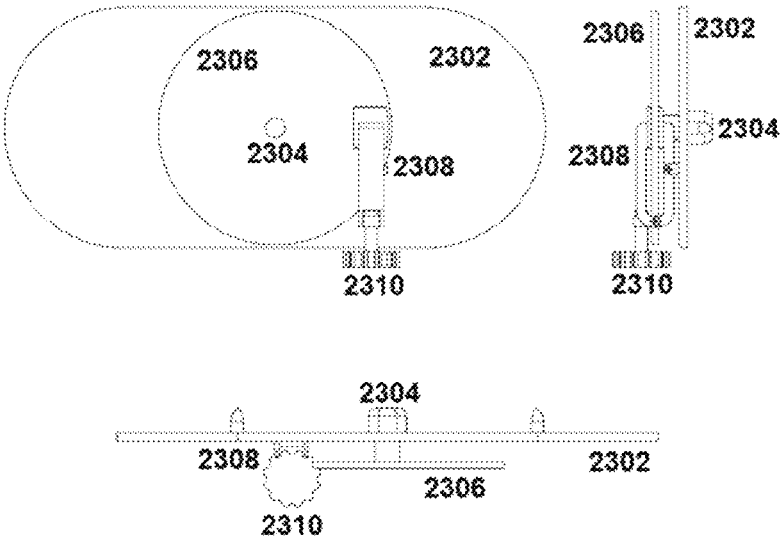
FIG. 23 is a diagram showing an embodiment of a module that can be added to an exercise device that includes a rotating disc and contactless brushes through which an electromagnetic force can be manipulated to increase resistance on the rotating disc, in accordance with an exemplary embodiment of the present disclosure.

FIG. 23 is a diagram of a device 2300 through which additional functionality can be added to an exercise device (which can be one of the exercise devices disclosed herein or other suitable exercise devices) by attachment of module 2302 to the exercise device, in accordance with an exemplary embodiment of the present disclosure. Module 2302 includes a rotating disc 2306 and a port 2304 which may be collinear with module port 1608 seen in FIG. 16, and which facilitates attachment to the exercise device. Module 2302 further includes contactless brushes 2308. An electromagnetic force can be manipulated by varying the distance between contactless brushes 2308 and rotating disc 2306 using knob 2310 to increase resistance or to provide additional functionality.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

While the invention has been illustrated and described in detail in the drawings and foregoing description, the same is to be considered as illustrative and not restrictive in character, it being understood that only some embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. An exercise device comprising:

a base frame having a base surface extending along a base plane;

a belt member supported by the base frame a selected distance from the base plane;

a front axle aligned along a front axis orthogonal to the base plane, the front axle supporting a front roller which rotates about the front axis to interface with the belt member;

a rear axle aligned along a back axis parallel to the front axis and orthogonal to the base plane, the rear axle supporting a rear roller which rotates about the back axis to interface with the belt member such that the belt member is routed around the front and rear rollers to form a continuous oval loop having opposing first and second planar extents each tangentially extending from the front roller to the rear roller;

a first foot support coupled to the first planar extent and configured to support a first foot of a user;

a second foot support coupled to the second planar extent and configured to support a second foot of the user;

an electric motor coupled to a selected one of the front or rear rollers;

a communications port; and an electronics circuit disposed within the housing configured to respectively operate the electric motor in an electric motor mode and in a power generator mode responsive to at least one input supplied by the user via the communications port, the electric motor operating in the electric motor mode to drive the belt about the first and second rollers, the electric motor operating in the power generator mode as an electrical generator to resist movement of the belt about the first and second rollers responsive to a human input to the first and second foot supports, the electronics circuit further configured to operate in a first assist mode in which the electronics circuit senses fatigue by the user in advancing the respective first and second foot supports during the power generator mode and, in response, to automatically transition to the electric motor mode, the electronics circuit further configured to operate in a second assist mode in which the electronics circuit senses fatigue by the user in advancing the respective first and second foot supports during the power generator mode and, in response, to maintain the electric motor in the power generator mode while reducing a magnitude of a virtual load that establishes a resistance level for the user to enable the user to continue advancing the respective first and second foot supports at a lower input level, the fatigue by the user sensed by the electronic circuit responsive to a detected change in the human input applied to the first and second foot supports and independently of any input by the user to the electronics circuit.

2. The exercise device of claim 1 further comprising an adjustable support configured for attaching the base frame to a structure.

3. The exercise device of claim 1 further comprising an adjustable base configured for adjusting an angle of the base frame.

4. The exercise device of claim 1 wherein the electronics circuit comprises a programmable processor configured to vary the virtual load to change an amount of resistance provided to resist movement of the first and second foot supports during the power generator mode, the detected change in the human input applied to the first and second foot supports sensed responsive to a detected change in the virtual load from a reduction in a magnitude of the human input applied to the first and second foot supports.

5. The exercise device of claim 4, wherein the processor uses regenerative braking to establish the amount of resistance provided to resist movement of the first and second foot supports during the power generator mode.

6. The exercise device of claim 1, wherein at least a selected one of the first or second foot supports is configured to rotate relative to the remaining one of the first or second foot supports along a plane parallel to the base plane.

7. The exercise device of claim 1 wherein the electronics circuit records and transfers electronic data relating to use of the exercise device via the port.

8. The exercise device of claim 1 wherein the electronics circuit provides adjustable control of resistance applied to the front axle by the electric motor.

9. An exercise device, comprising:

an enclosed housing having a base surface;

a first roller supported within the housing for rotation about a first roller axis perpendicular to the base surface;

a second roller supported within the housing for rotation about a second roller axis parallel to the first roller axis;

an electric motor disposed within the housing and coupled to the first roller;

an endless belt disposed within the housing and routed along a belt path that passes around the first roller and the second roller;

a first foot support plate external to the housing and affixed to a first side of the belt adapted to support a first foot of a user;

a second foot support plate external to the housing and affixed to an opposing second side of the belt adapted to support a second foot of the user;

a communications port; and an electronics circuit disposed within the housing configured to operate the electric motor in an electric motor mode and in a power generator mode responsive to at least one input supplied by the user via the communications port, the electric motor operating in the electric motor mode to drive the belt about the first and second rollers, the electric motor operating in the power generator mode as an electrical generator to resist movement of the belt about the first and second rollers responsive to a human input supplied to the first and second foot support plates to repetitively advance the first and second foot support plates, the electronics circuit further configured to operate in an assist mode in which the electronics circuit senses fatigue by the user in advancing the respective first and second foot supports and, in response, reduces a resistance applied to the first and second foot supports while maintaining the electric motor in the power generator mode to enable the user to continue advancing the respective first and second power supports in opposition to the reduced resistance, the electronics circuit sensing the fatigue by the user responsive to a detected reduction in a magnitude of the human input applied to the first and second foot supports independently of any input supplied by the user to the electronics circuit.

10. The exercise device of claim 9, wherein the first foot support plate is configured for rotation between an aligned position and a transverse position, wherein in the aligned position the first foot support plate has a longest dimension that is parallel to the first side of the belt, and wherein in the transverse position the first foot support plate has the longest dimension that is perpendicular to the first side of the belt.

11. The exercise device of claim 9, further comprising an adjustable base configured for adjusting an angle of the housing with respect to a base surface on which the housing rests.

12. The exercise device of claim 9, wherein the electronics unit operates the electric motor as a generator in the resistance mode.

13. The exercise device of claim 9, further comprising a first foot strap coupled to the first foot support plate and a second foot strap coupled to the second foot support plate.

14. The exercise device of claim 9, wherein the first axis and the second axis are each disposed in a vertical direction relative to a surface on which the exercise device rests.

15. The exercise device of claim 9 wherein the respective first and second foot support plates are configured to reciprocate in alternating forward and backward paths during bi-directional movement of the belt about the first and second rollers.

16. Exercise device of claim 15, further comprising a first guide track that facilitates sliding movement of the first foot support plate along said forward and backward paths in a linear direction parallel to the first side of the belt, and a second guide track that facilitates sliding movement of the second foot support plate along said forward and backward paths in a linear direction parallel to the second side of the belt.

17. An exercise device, comprising:

a base housing having a base surface;

spaced apart first and second rollers supported by the base housing and configured to establish an oval belt path for a continuous belt that forms parallel first and second planar extents that tangentially extend between the first and second rollers in a direction normal to the base surface;

a first foot support coupled to the first planar extent and configured to support a first foot of a user;

a second foot support coupled to the second planar extent and configured to support a second foot of the user;

an electric motor coupled to a selected one of the first or second rollers; and an electronics circuit configured to respectively operate the electric motor in an electric motor mode and in a power generator mode responsive to at least one input supplied by the user via the communications port, the electric motor operating in the electric motor mode to drive the belt about the first and second rollers, the electric motor operating in the power generator mode as an electrical generator to resist movement of the belt about the first and second rollers responsive to a human input to the first and second foot supports, the electronics circuit further configured to operate in an assist mode in which the electronics circuit senses fatigue by the user in advancing the respective first and second foot supports and, in response, maintains the electric motor in the power generator mode while adjusting a current supplied to the electric motor to reduce an amount of effort required by the user during continued advancement of the first and second foot supports in the power generator mode, the electronics circuit sensing the fatigue by the user in response to a gradual reduction in the human input applied to the first and second foot supports as sensed by a change in a virtual load and independently of any input, by the user, to the electronics circuit.

18. The exercise device of claim 17, wherein the assist mode is characterized as a first assist mode, and wherein the electronics circuit is further configured to operate in a second assist mode in which the electric motor is transitioned transitioning from the power generator mode to the electric motor mode responsive to sensed fatigue by the user.

19. The exercise device of claim 17, wherein the assist mode comprises reducing a resistance of the electric motor responsive to the sensed fatigue by the user.

20. The exercise device of claim 17, wherein at least a selected one of the first or second foot supports is configured to be rotated nominally 90 degrees with respect to the remaining one of the first or second foot supports about a plane parallel to the base surface.

* * * * *